United States Patent [19]

Ragnebring

[11] Patent Number: 4,648,336

[45] Date of Patent: Mar. 10, 1987

[54] DEVICE FOR FOLDING AN EDGE OF A FABRIC FOR MAKING A HEM

[75] Inventor: Chris Ragnebring, Viskafors, Sweden

[73] Assignee: Akab of Sweden AB, Boras, Sweden

[21] Appl. No.: 708,843

[22] Filed: Mar. 6, 1985

[30] Foreign Application Priority Data

Mar. 6, 1984 [SE] Sweden ..... 8401218

[51] Int. Cl.[4] ..... D05B 35/02; D05B 27/00; B31B 1/58

[52] U.S. Cl. ..... 112/147; 112/304; 493/423; 493/441

[58] Field of Search ..... 112/147, 141, 153, 152, 112/304; 493/163, 179, 423, 436, 441

[56] References Cited

U.S. PATENT DOCUMENTS

| | | | |
|---|---|---|---|
| Re. 29,758 | 9/1978 | Rockerath | 112/141 |
| 4,022,457 | 5/1977 | Marin et al. | 493/441 |
| 4,066,025 | 1/1978 | Speer | 112/147 |
| 4,507,557 | 2/1986 | Freermann | 112/304 |
| 4,546,713 | 10/1985 | Speer | 112/141 |
| 4,547,183 | 10/1985 | Mowry | 493/441 |
| 4,588,393 | 5/1986 | Cogswell et al. | 493/441 |

FOREIGN PATENT DOCUMENTS

| | | | |
|---|---|---|---|
| 2145269 | 3/1973 | Fed. Rep. of Germany | 493/441 |
| 2314970A | 3/1973 | Fed. Rep. of Germany . | |
| 127120 | 5/1919 | United Kingdom | 112/141 |

*Primary Examiner*—Werner H. Schroeder
*Assistant Examiner*—Joseph S. Machuga
*Attorney, Agent, or Firm*—Cushman, Darby & Cushman

[57] ABSTRACT

A device for folding at least one edge of a fabric for making a single or a double hem, said fabric edge being passed through shaping means contained in the device. The object of the invention is to provide a folding device, which within a relatively large area with respect to the most common fabrics, is insensitive to variations in thickness of the fabric, whether several fabric edges are to be folded simultaneously or whether transverse seem with considerable thickness occur. This object has been solved by the fact that the shaping means comprises portions of at least one endless, driven band, which is twisted in correspondance with the gradual folding of the fabric edge during the transport thereof through the device and said band being arranged to cooperate with at least one fixed rule arranged in direct connection with at least a part of the band portions.

4 Claims, 20 Drawing Figures

DEVICE FOR FOLDING AN EDGE OF A FABRIC FOR MAKING A HEM

The present invention refers to a device for folding at least one edge of a fabric for making a single or double hem, said fabric edge being passed through shaping means contained in the device.

BACKGROUND OF THE INVENTION

Hem shaping means are known in a plurality of different embodiments. The most common means consists of a helical, conical sleeve through which the fabric edge is passed at the same time as the folding takes place. There is also previously known a hem shaping means consisting of two folding bars provided with upwards directed portions between which and the bars the folding takes place. Fixed bars, however, involves, that the once chosen space between the bars for a safe-folding and transport of the fabric edge through the folding device cannot be instantaneously changed in order to let a transverse seam with a considerably larger thickness than the actual fabric edge pass. This means that fabrics with transverse hems cannot or only with difficulty be sewn in such hem-shaping means, which is an obvious drawback.

SUMMARY OF THE INVENTION

The object of the present invention is to provide a folding means, which within a relatively large area with respect to the most common fabrics, is insensitive for variations of the thickness of the fabric, whether more than one fabric edge is to be folded simultaneously or if transverse seams with a considerable thickness occur. This object has been solved by the fact, that the shaping means comprises portions of at least one endless, driven band, which is twisted in correspondance with the gradual folding of the fabric edge during the transport thereof through the device and said band being arranged to cooperate with at least one fixed rule arranged in direct connection with at least a part of the band portions.

DESCRIPTION OF EMBODIMENTS

Figure 1:
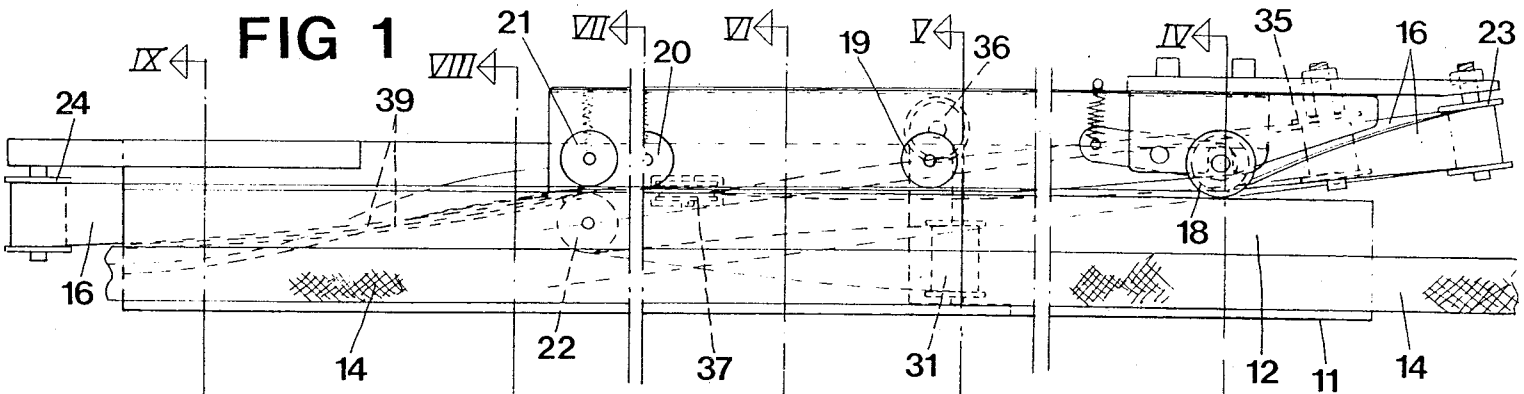
FIG. 1 shows the folding device according to the invention in a view from above.

The folding device according to the invention consists of a feed table 11 on the table top 12 of which the fabric 13, which is to be provided with a fold is transported. The transport takes place by means of an endless band 14 (only one band part is shown), which feeds the fabric in the longitudinal direction of the table. At one side edge of a table a vertical rail making one first folding rule of the folding device is arranged. Outside the rule 15 there is arranged a first endless transport band 16, along which a first shaping section 17 is arranged essentially vertically and substantially parallel to and in contact with the rule 15. A number of guide rollers 18–21 and a pulley roll keep the band part in question in position. The endless band 16 is by way of the pulley rolls 23, 24, the drive roll 25, the stretching roll 26 and the pulley rolls 27 and 28 driven in the direction of the arrow 29.

A second endless band 30 is arranged opposite the rule 15 and cooperating with this, said band at the beginning of the first shaping section 17 has a substantial horizontal position and is gradually towards the pulley roll 22 twisted to vertical position. The band 30 extends from the pulley roll 22 further to the pulley rolls 31 and 32, to the drive roll 33 and by way of a stretching roll 34 to the pulley roll 35, and returns after that to the pulley roll 22. The twisting of the second band part 30 from horizontal position at the guide roll 18 to vertical position at the pulley roll 22 is supported and guided by support rolls 36 and 37.

The first band 16 continues from the press nip between the rolls 21 and 22 from vertical position to horizontal position at the pulley roll 24, and during this twisting movement, i.e. a second shaping section 38, the band part in question will be brought to contact against a second rule 39. This is also twisted in the corresponding way as the band section in question and this rule is in the same way as the rule 15 fixed to the table top 12. All the rolls supporting and driving the two endless bands are mounted in a frame 40.

Figure 4:
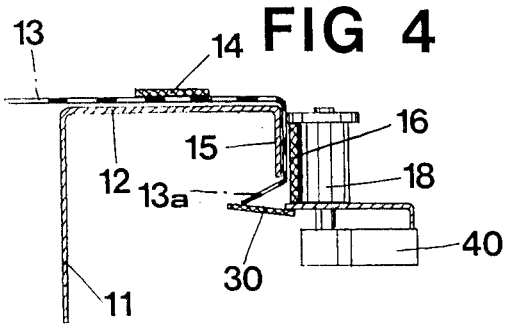
FIGS. 4–9 are sections according to the lines IV—IV, V—V, VI—VI, VII—VII, VIII—VIII och IX—IX respectively in FIGS. 1 and 2.
Figure 8:
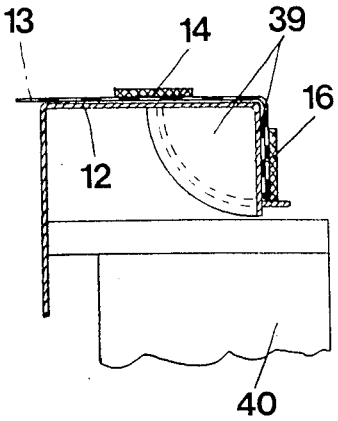
Figure 5:
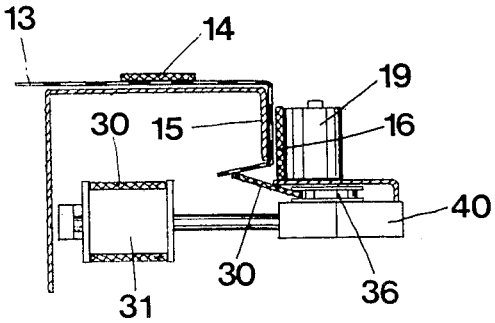
Figure 6:
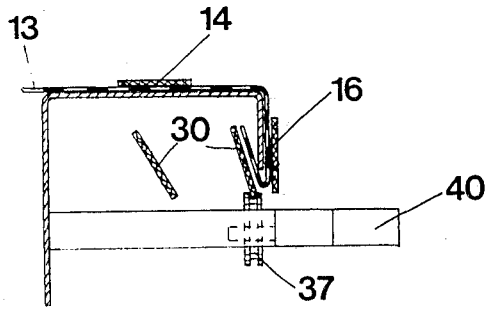
Figure 9:
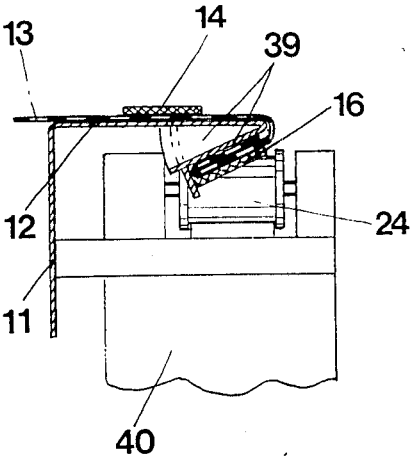
Figure 7:
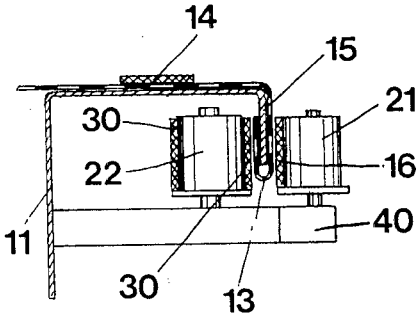
Figure 10:
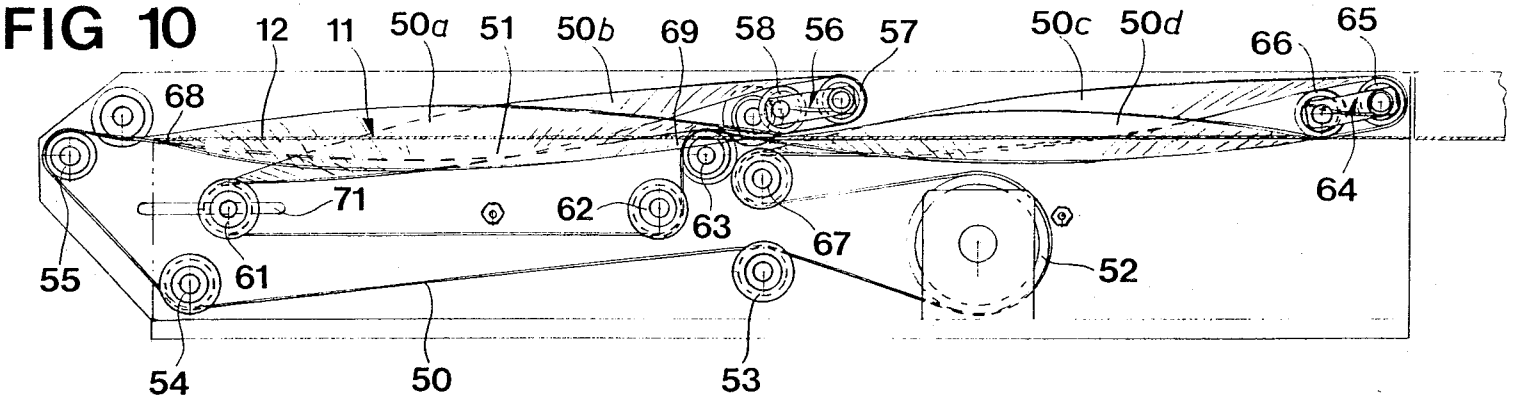
FIG. 10 shows in side view and in section a modified embodiment of the folding device according to the invention.
Figure 11:
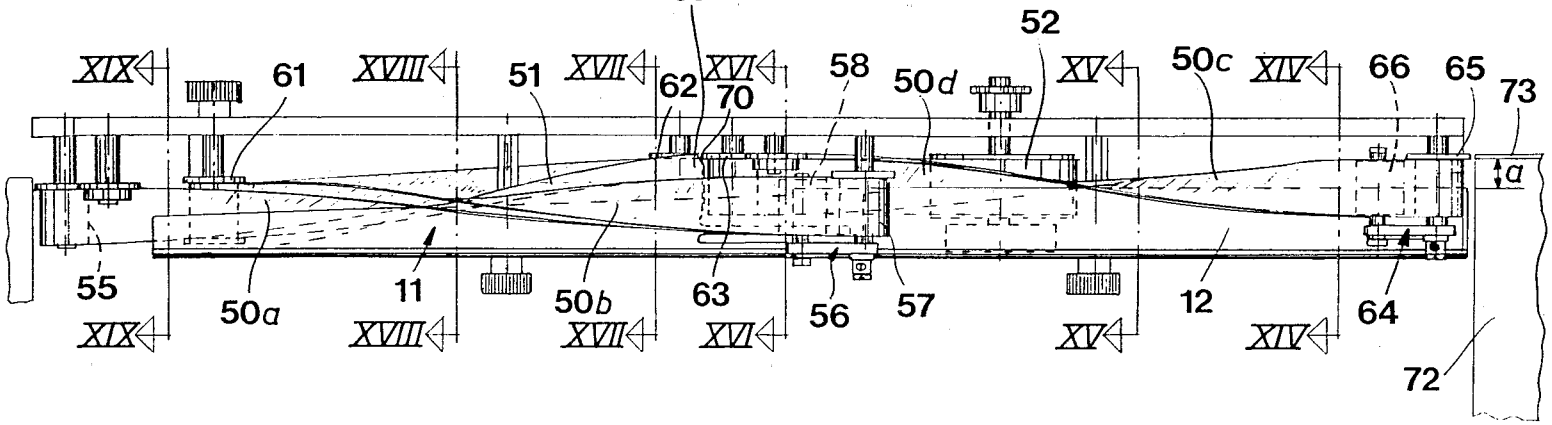
FIG. 11 shows the folding device according to FIG. 10 in a view from above.
Figure 12:
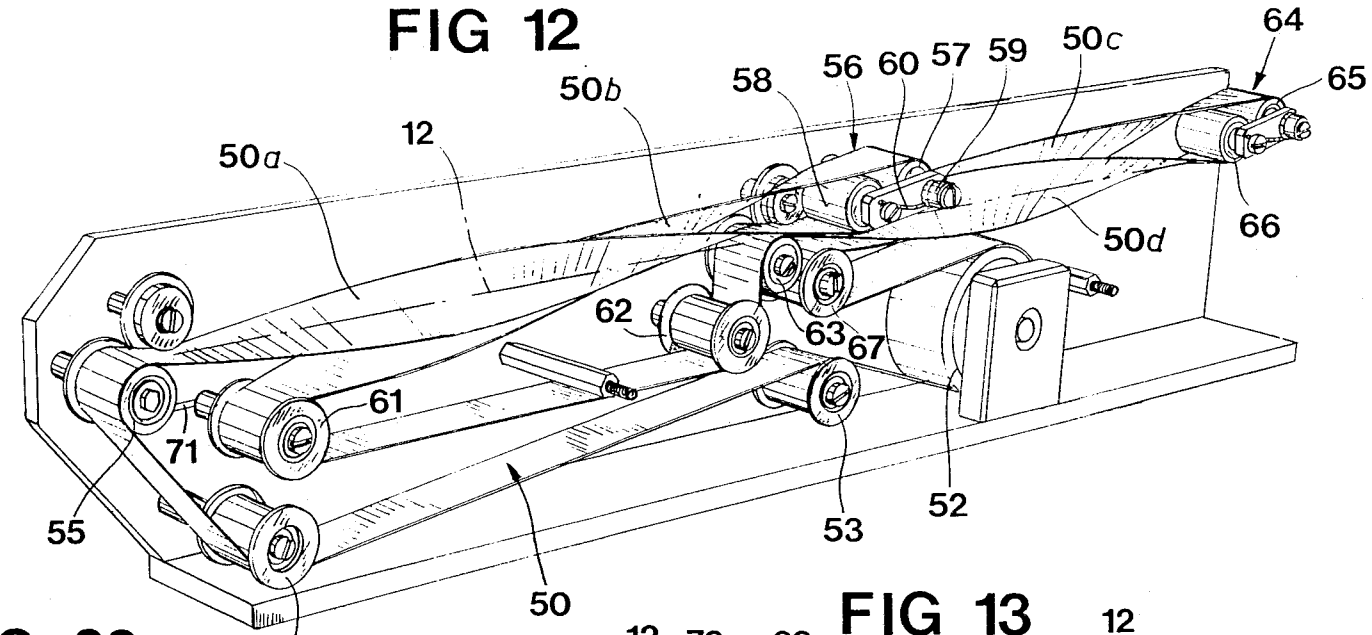
FIG. 12 shows the folding device according to FIGS. 10 and 11 in perspective.
Figure 13:
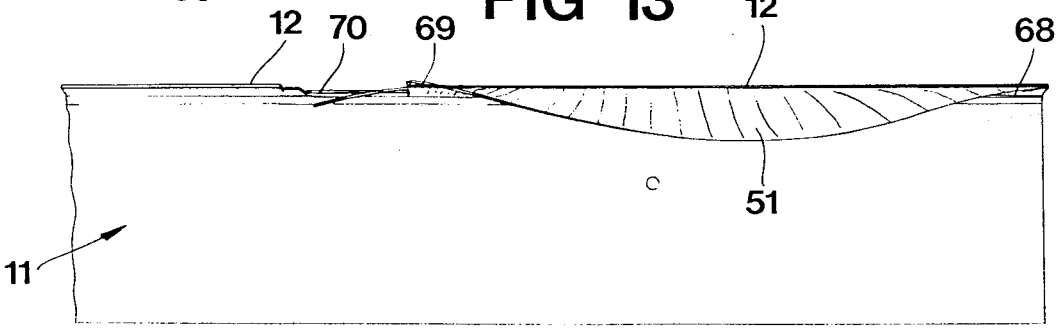
FIG. 13 shows a portion of the feed table 11 seen from inside the folding device.
Figure 20:
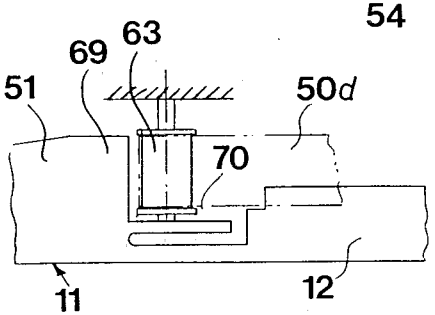
FIG. 20 shows the central portion of the feed table in a view from above.

The folding device according to the invention functions in the following way. The two bands 16 and 30, which are driven by a common motor (not shown) are displaced in the direction of the arrow 29, i.e. at the shaping sections 17 and 38 in the same direction as the transport band 14. A fabric 13 which is clamped between the band part 14 and the table 12 will thus be displaced along the entire folding device. The fabric 13 is then guided into the folding device, so that the edge **13*a* will hang over the table edge 12, as is shown in FIG. 4. The overhang 13*a* is guided in between the rule 15 and the first band part 16. The projecting end portion of the fabric edge will by that come to contact with the second band part 30, which at the entrance of the fabric edge in the folding device takes a substantial horizontal position. Concurrently with the displacement of the fabric edge through the folding device the end portion 13*a* will be folded up more and more against the inside of the rule 15. By means of the second band part 30, which is twisted from horizontal position to vertical position. The vertical position of the first band part 16 helps to transport the fabric edge on the outer side of the rule 15**.

Figure 2:
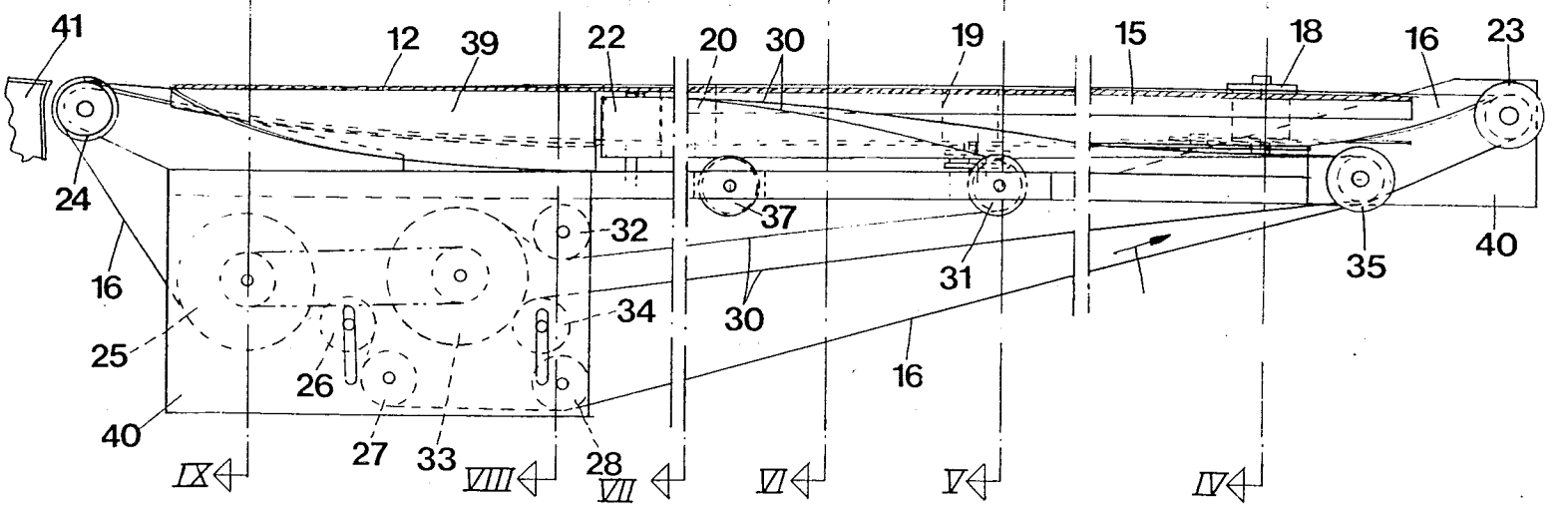
FIG. 2 shows the folding device according to FIG. 1 in a side view.
Figure 3:
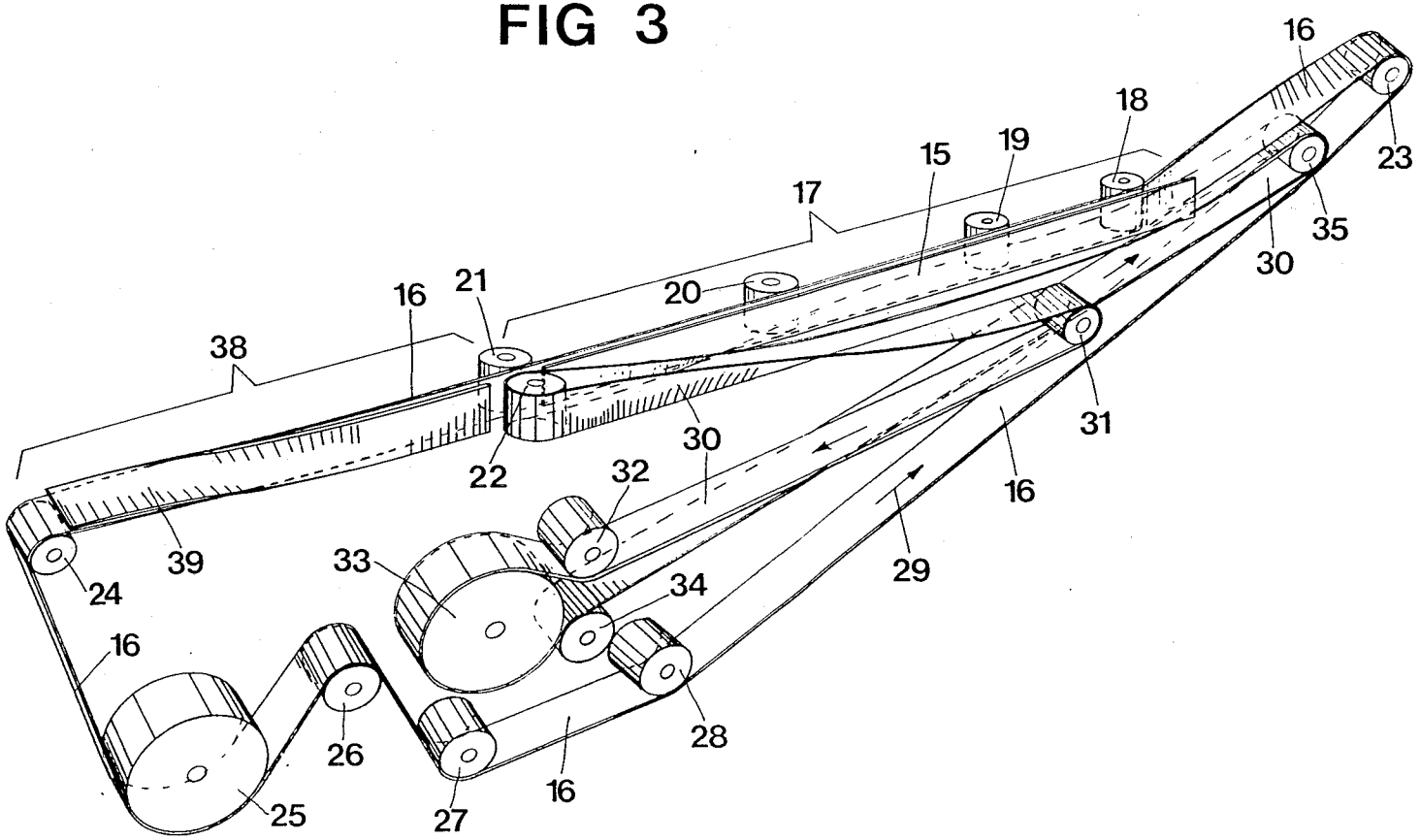
FIG. 3 shows in perspective endless bands and rules contained in the folding device.

At the section VII—VII in FIGS. 1 and 2 the fabric edge has been folded in U-shaped about the rule 15 and the two shanks of the U are fixed by the bend part 16 and 30 each. At the section VIII—VIII the fabric edge has left its engagement with the band part 30 and the end portion 13*a* of the fabric edge has been brought into contact with a second rule 39 of the folding device extending from the pulley roll 22 vertically to horizontal position at the pulley roll 24. The fabric edge will in cooperation with the first band part 16 be gradually folded in the second shaping 38 in the direction towards the table top 12, so that when the fabric edge leaves the pulley roll 24 a double folded hem has been provided.

In direct connection to the pulley roll 24 there is arranged a connection approach 41 to a sewing machine, where the hem is sewn. In order to permit also very thick material portions in the form of transverse seams get past the guide rolls 18, 19, 20 and 21. These are spring-loaded and can thus spring aside if the material thickness suddenly is increased.

The embodiment according to the FIGS. 10–19 differs from the previous embodiments by the fact that the shaping means comprises one single endless, driven band 50 cooperating with a shaping rule 51, which is fixed to the feed table 11. The endless band 50 is driven by a drive roll 52 by a motor (not shown). The band 50 extends from the drive roll 52 by way of three pulley rolls 53, 54 and 55 to a position in which a band is located on a level with the table top 12 of the feed table 11. The band portion 50*a* between the roll 55 and the roll pair 56 is twisted 180° so that the band portion during a substantial part of its length will be in contact with the correspondingly shaped shaping rule 51. The roll pair 56 consists of the rolls 57 and 58, of which the first mentioned roll 57 is stationary and the second roll 58 is pivotable about axle 59 of the first roll 57. A spring 60 which gives the roll 58 a contact pressure against the table top 12 is also arranged at said axle 59. From the roll pair 56 the band continues with a 180° twisting to the roll 61 located on a somewhat lower level as compared to the roll 55. The band part 50*b* follows during a portion of its length the twisting of the band part 50*a*. The band 50 continues from the roll 61 to the pulley rolls 62 and 63 and then further as a band part 50*c* in 180° twisting to a second roll pair 64, which in the same way as the first roll pair 56 consists of a stationary roll 65 and a roll 66 which with respect to this is pivotable and spring-loaded. This roll 66 presses a portion of the band part 50*d* to contact against the table top 12. The band part 50*d* continues from the undersides of the roll pair 64 with 180° twisting to the pulley roll 67 and then back to the drive roll 52.

The feed table 11 is as previously mentioned provided with a shaping rule 51 consisting of a plate strip, which at one end 68 of the feed table is located flash and on the underside of the tabletop 12. The roll is twisted 180° and its opposite end portion 69 connects tangentially on to the pulley roll 63, which projects into a recess 70 in the table top 12. In order to provide a sufficient track tension one of the pulley rolls, e.g. the roll 61 is displaceably arranged in a groove 71 along which the pulley roll is attachable.

Figure 14:
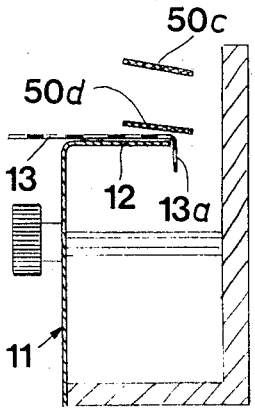
FIGS. 14–19 are sections according to the lines XIV—XIV, XV—XV, XVI—XVI, XVII—XVII, XVIII—XVIII and XIX—XIX in FIG. 11.
Figure 15:
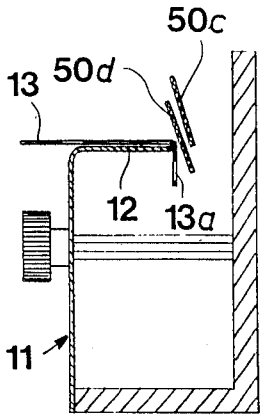
Figure 16:
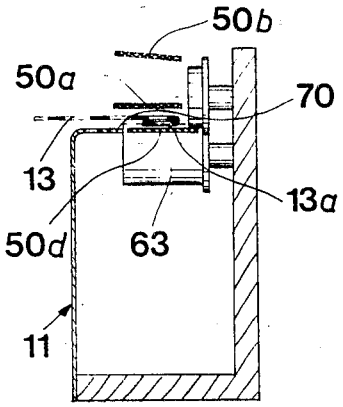
Figure 17:
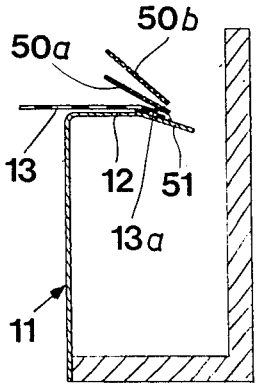
Figure 18:
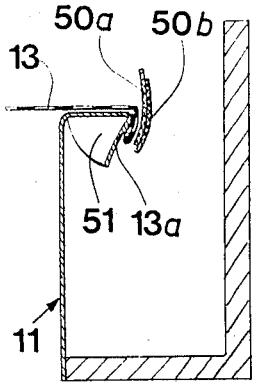
Figure 19:
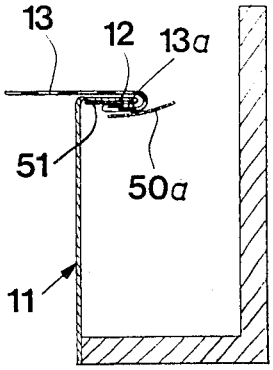

In the feeding direction of the fabric as seen from the front of the folding device there is arranged an infeed table 72 with stop edge 73, which is located at the distance a (FIG. 11) from the rear side edge of the table top 12, which distance a is a measure of the length of the future double hem. By changing the measure a, for example by displacing the folding device somewhat sidewards, the width of the hem is also changed. The device functions in the following way:

A piece of fabric 13, e.g. a sheet, which by appropriate transport means as endless transport bands, not shown, is transported along the feed table 72 with the fabric edge which is to be hemmed, contacting the side edge 73 of the feed table, will be inserted under the roll 66 of the first roll pair 64 and gets its continued transport movement by the endless band 50 of the folding device in cooperation with the table top 12 and the shaping rule 51 respectively. When the piece of fabric has reached the section line XIV—XIV in FIG. 11 the piece of fabric 13 is by the band portion 50*d* pressed against the table top 12, while the projecting portion 13*a* of the piece of fabric 13 corresponding to the measure a will hang freely downwards along the free longitudinal side edge of the table top, as is shown in FIG. 14. During the continued displacement along the feed table 11, 12 on to the section line XVI—XVI the projecting fabric edge 13*a* will by the 180° twisted band part 50*d* be turned to contact the underside of the table top 12. Just opposite the roll 63 in the table top 17 there is provided a recess 70 permitting the fabric edge 13*a* located on the underside of the table top to leave the table top as is shown in FIG. 16. The continued displacement of the piece of fabric through the folding device is now taken over by the band part 50*a*, which transports the folded fabric edge along the shaping rule 51. Since the band part 50*a* from the roll pair 56 to the roll 55 is twisted 180° in the same way as the shaping rule 51, the ones folded fabric edge 13*a* will be exerted to a further folding, so that a double folded hem is provided.

The invention is not limited to the shown embodiment but a plurality of variance are possible within the scope of the claims.

What we claim is:

1. A device for folding at least one edge of a fabric for making a single or a double hem, said device comprising: a feed table having a horizontally arranged top on which said fabric is intended to be placed substantially horizontally with a side edge to be folded hanging over a side edge of the feed table; transport means for feeding the fabric along the feed table through said device; fold shaping means comprising portions of two endless bands of which at least one is twisted in correspondence with the gradual folding of the fabric edge during the feeding thereof through said device; said fold shaping means further comprising first and second fixed rules, said first rule having opposite flat sides being a substantially vertical extension of the horizontally arranged table top, the first endless band within the area for the first rule being arranged substantially in parallel with and in direct contact with a fabric edge placed between said first band and one flat side of the first rule, the second endless band at the front end portion of the first rule as seen in the feeding direction of the fabric being in cross section substantially horizontal, and located below the first rule and at the back end portion of the first rule being substantially vertical and located on the opposite flat side of the first rule as compared to the first band.

2. A device as in claim 1 wherein the portion of the first endless band which is positioned in front of the first rule seen in the feeding direction of the fabric, is arranged at an angle to the first rule.

3. A device as in claim 2 wherein the band portion of the first band which is positioned after the first rule is twisted 90° and the second rule opposite to said twisted band portion, is formed with a corresponding twist from vertical to horizontal position as seen in a cross-section.

4. A device as in claim 1 wherein the band portion of the first band which is positioned after the first rule is twisted 90° and the second rule opposite to said twisted band portion, is formed with a corresponding twist from vertical to horizontal position as seen in a cross-section.

* * * * *